US009055815B2

(12) United States Patent
Chiu

(10) Patent No.: US 9,055,815 B2
(45) Date of Patent: Jun. 16, 2015

(54) PRES-CONTROL TYPE SLIDING RAIL ASSEMBLY

(71) Applicant: Nan Juen International Co., Ltd., Yingge Dist., New Taipei (TW)

(72) Inventor: I-Hsiang Chiu, New Taipei (TW)

(73) Assignee: Nan Juen International Co., Ltd., New Taipei (TW)

( * ) Notice: Subject to any disclaimer, the term of this patent is extended or adjusted under 35 U.S.C. 154(b) by 113 days.

(21) Appl. No.: 13/846,787

(22) Filed: Mar. 18, 2013

(65) Prior Publication Data

US 2014/0265792 A1 Sep. 18, 2014

(51) Int. Cl.
*A47B 88/16* (2006.01)
*A47B 88/04* (2006.01)

(52) U.S. Cl.
CPC ..... *A47B 88/16* (2013.01); *A47B 2210/0016* (2013.01); *A47B 88/0418* (2013.01); *A47B 2088/0444* (2013.01)

(58) Field of Classification Search
CPC ..... A47B 88/08; A47B 88/10; A47B 88/14; A47B 88/16; A47B 88/0422; A47B 2210/007; A47B 2210/0016; A47B 2210/0018; A47B 2210/0059; A47B 2210/0081; A47B 2210/0083; A47B 2088/0437; A47B 2088/0444; A47B 88/0418
USPC ..... 312/330.1, 333, 334.1; 384/21
See application file for complete search history.

(56) References Cited

U.S. PATENT DOCUMENTS

| | | | | |
|---|---|---|---|---|
| 4,872,734 | A * | 10/1989 | Rechberg | 312/333 |
| 5,085,523 | A * | 2/1992 | Hobbs | 384/21 |
| 5,871,265 | A * | 2/1999 | Stewart et al. | 312/334.8 |
| 6,199,967 | B1 * | 3/2001 | Bayles et al. | 312/334.7 |
| 6,375,290 | B1 * | 4/2002 | Lin et al. | 312/334.46 |
| 8,132,875 | B2 * | 3/2012 | Juang | 312/334.47 |
| 2005/0017614 | A1 * | 1/2005 | Cirocco et al. | 312/333 |
| 2007/0170830 | A1 * | 7/2007 | Huang | 312/334.47 |
| 2013/0058596 | A1 * | 3/2013 | Chen et al. | 384/7 |

* cited by examiner

*Primary Examiner* — Daniel J Troy
*Assistant Examiner* — Ryan A Doyle

(57) ABSTRACT

A press-control type sliding rail assembly includes an intermediate rail, an inner rail slidably coupled to the intermediate rail, a limiter member pivotally mounted at the intermediate rail and defining opposing first stop flange and second stop flange, and a stop block located at the inner rail for stopping against the first stop flange to prevent falling of the inner rail out of the intermediate rail when the second stop flange is pressed by an external force to bias the limiter member in moving the first stop flange toward the inner rail.

3 Claims, 10 Drawing Sheets

PRES-CONTROL TYPE SLIDING RAIL ASSEMBLY

BACKGROUND OF THE INVENTION

1. Field of the Invention

The present invention relates to a sliding rail assembly for coupling between a drawer and a drawer cabinet and more particularly, to a press-control type sliding rail assembly that facilitates mounting and dismounting and prevents falling of the inner rail out of the intermediate rail.

2. Description of the Related Art

Sliding rail assemblies are widely used with drawers in drawer cabinets for allowing the drawers to be smoothly moved in and out respective drawer cabinets. To facilitate application and cleaning, detachable multi-rail type sliding rail assemblies are created. A detachable multi-rail type sliding rail assembly has a stop member provided between the inner rail and the outer rail to prohibit falling of the inner rail with the drawer out of the outer rail when the drawer is pulled out of the drawer cabinet. When going to detach the drawer from the drawer cabinet, the user must manually bias the stop members of the two sliding rail assemblies from the locking position to the unlocking position at the same time. If the two stop members of the two sliding rail assemblies are not accurately biased to the unlocking position, the user cannot detach the drawer from the drawer cabinet. Thus, it is inconvenient to detach the drawer from the drawer cabinet.

SUMMARY OF THE INVENTION

The present invention has been accomplished under the circumstances in view. It is the main object of the present invention to provide a press-control type sliding rail assembly, which is highly detachable, facilitating mounting and dismounting, allowing quick removal of the drawer from the drawer cabinet and preventing falling of the component parts during application.

To achieve this and other objects of the present invention, a press-control type sliding rail assembly comprises an inner rail affixed to a drawer, an outer rail affixed to a drawer cabinet, and an intermediate rail coupled between the inner rail and the outer rail. The inner rail defines opposing first position-limit end and first mounting end. The intermediate rail defines opposing second position-limit end and second mounting end. The first position-limit end and the second mounting end extend in a first direction. The first mounting end and the second position-limit end extend in a second direction opposite to the first direction. The intermediate rail comprises a limiter member pivotally mounted at the second position-limit end. The limiter member defines opposing first stop flange and second stop flange. The first stop flange is spaced below the second position-limit end. When the first stop flange is moved to the inner rail, the second stop flange is moved away from the inner rail. The inner rail comprises a stop block located at the first position-limit end and facing toward the intermediate rail. The stop block is disposed at a lower side between the first position-limit end and the first mounting end.

Thus, the limiter member can be biased relative to the intermediate rail to move the first stop flange and the second stop flange in reversed directions. When the second stop flange is pressed by an external force to move the first stop flange in direction away from the intermediate rail toward the inner rail, the first stop flange can stop the stop block, preventing falling of the inner rail out of the intermediate rail.

Therefore, the press-control type sliding rail assembly of the invention has a simple structure and facilitates mounting and dismounting.

DETAILED DESCRIPTION OF THE PREFERRED EMBODIMENT

Figure 1:
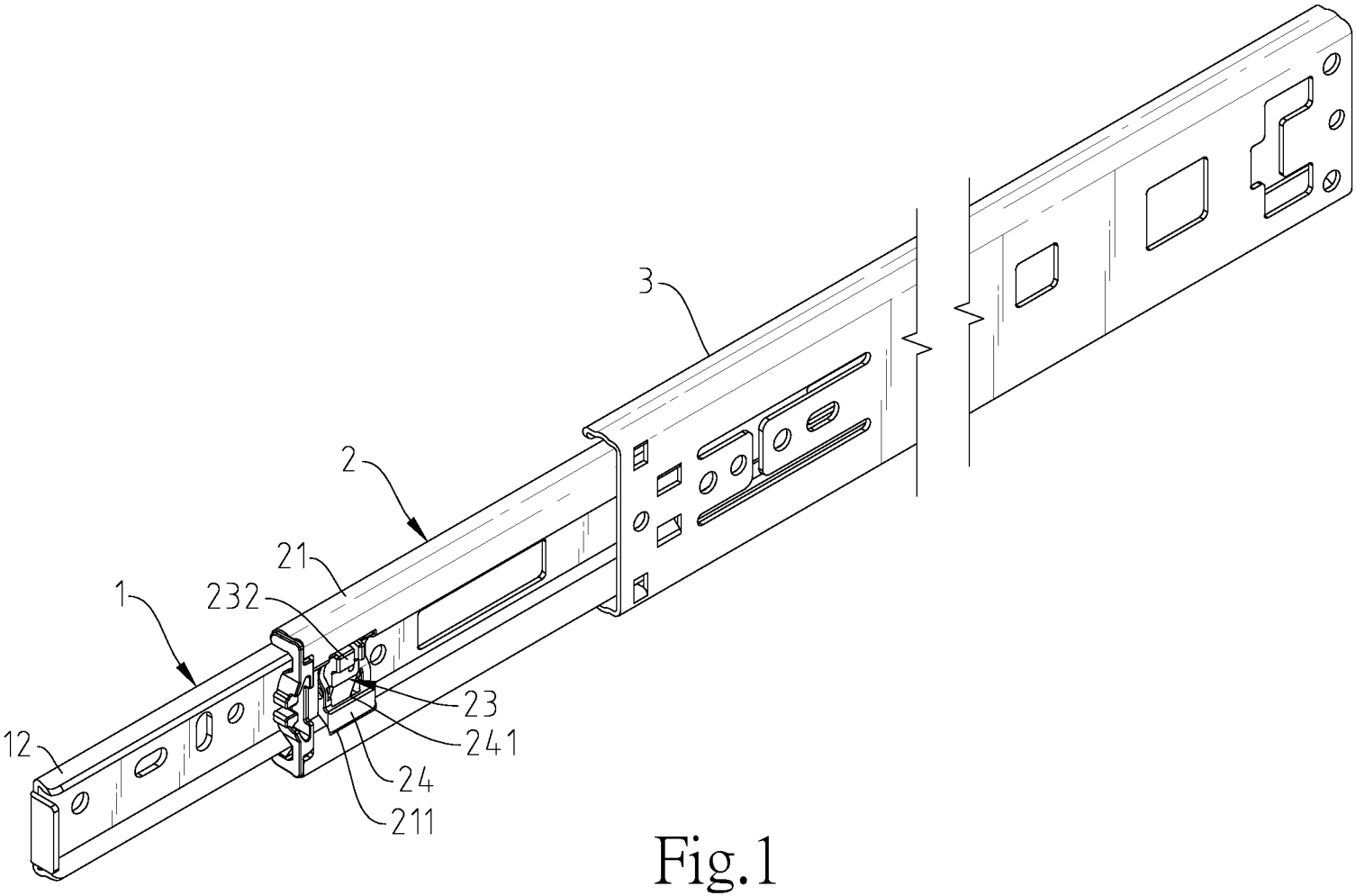
FIG. 1 is a schematic rear elevational view of a press-control type sliding rail assembly in accordance with the present invention.
Figure 2:
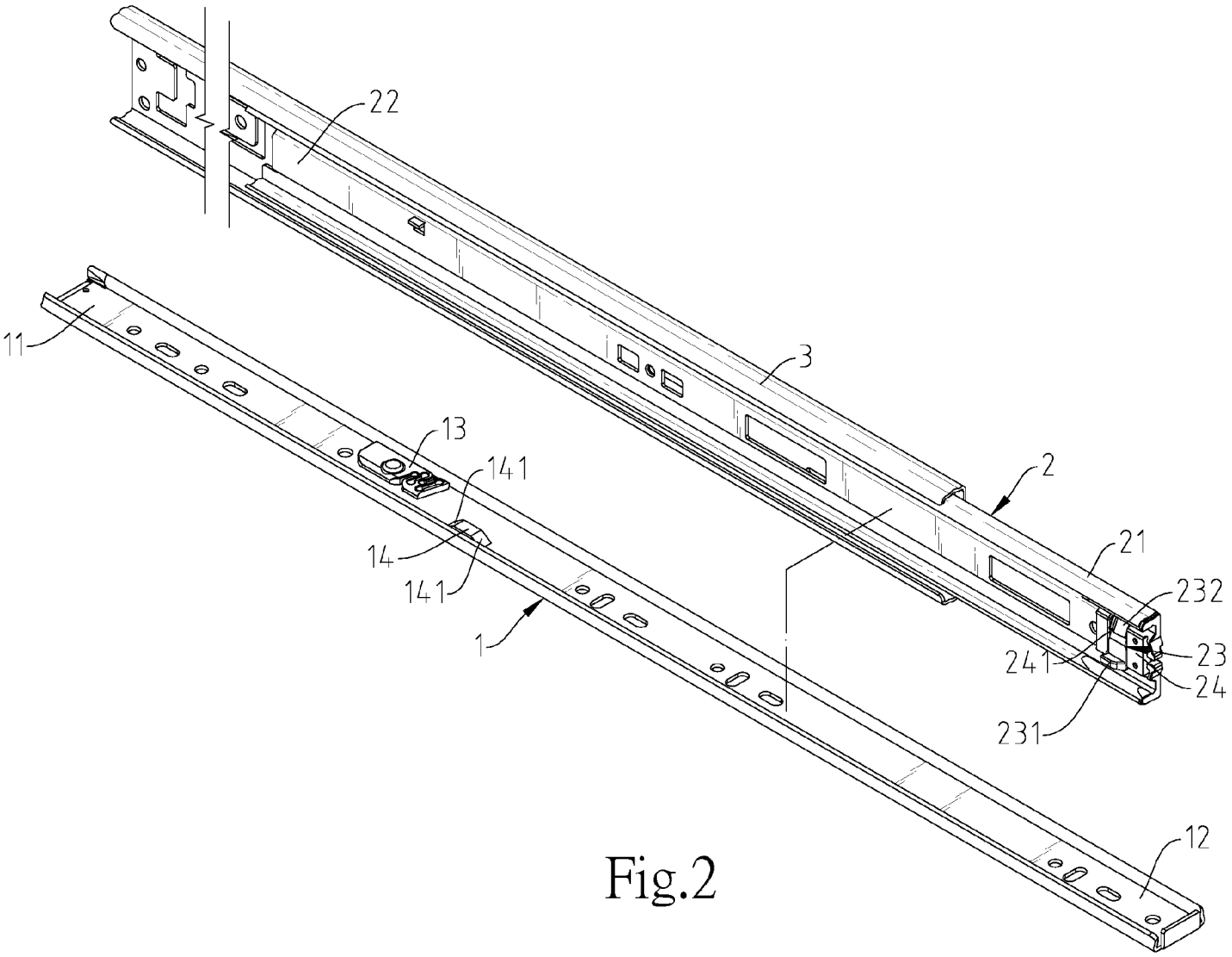
FIG. 2 is an exploded view of the press-control type sliding rail assembly in accordance with the present invention.
Figure 3:
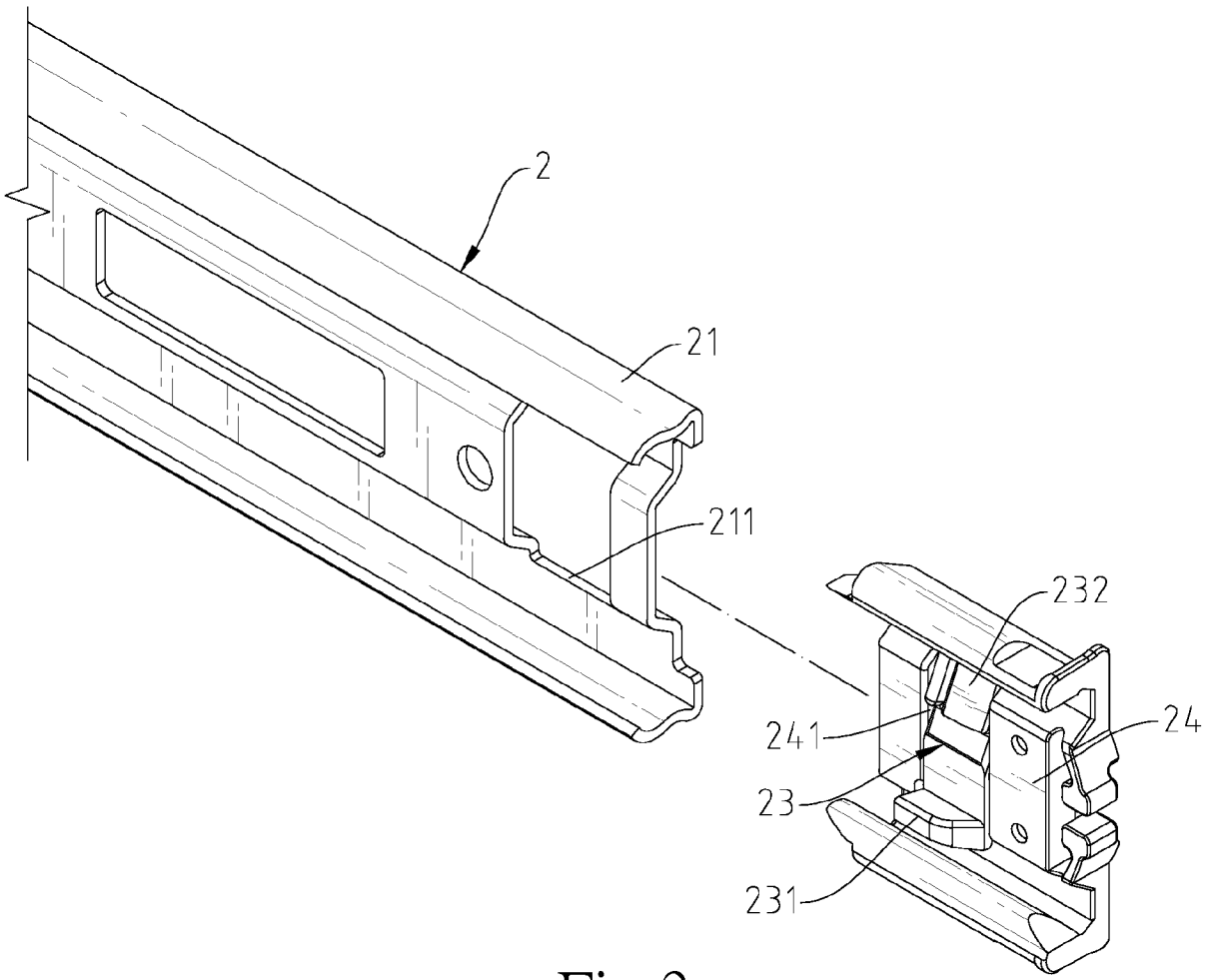
FIG. 3 is an exploded view of the intermediate rail and the connection block in accordance with the present invention.
Figure 4:
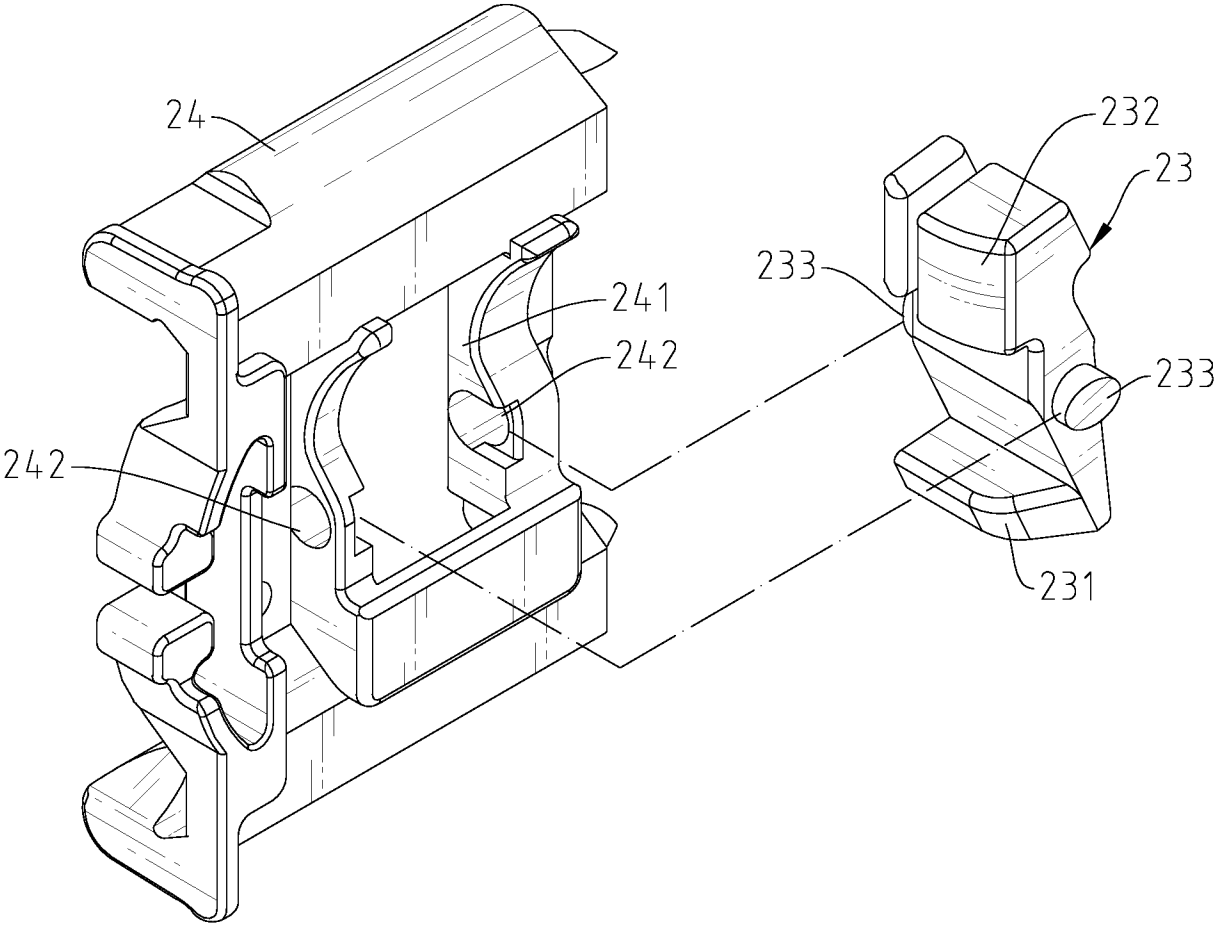
FIG. 4 is an exploded view of the connection block and the limiter member of the press-control type sliding rail assembly in accordance with the present invention.

Referring to FIGS. 1-4, a press-control type sliding rail assembly in accordance with the present invention is shown comprising an inner rail 1, an intermediate rail 2 and an outer rail 3. The intermediate rail 2 is coupled between the inner rail 1 and the outer rail 2 in such a manner that the inner rail 1 can be moved in and out of the intermediate rail 2, and the intermediate rail 2 can be moved in and out of the outer rail 3.

The inner rail 1 comprises opposing first position-limit end 11 and first mounting end 12, a stop block 13 located at a lower side of the inner wall thereof and spaced between the first position-limit end 11 and first mounting end 12, and a push block 14 located at an upper side of the same inner wall and disposed adjacent to the push block 14 and spaced between the stop block 13 and the first mounting end 12. Further, the push block 14 defines a beveled guide face 141 at each of opposing front and rear sides thereof.

The intermediate rail 2 comprises opposing second position-limit end 21 and second mounting end 22, a connection block 24 attached to the second position-limit end 21, and a limiter member 23 mounted in the connection block 24. The connection block 24 defines therein an opening 241, and two pivot holes 242 that are axially aligned at two opposite lateral sides of the opening 241. The second position-limit end 21 has a through hole 211 defined therein and aimed at the opening 241. The limiter member 23 is located at an inner side relative to the connection block 24, comprising two pivot rods 233 located at two opposite lateral sides thereof and respectively pivotally coupled to the pivot holes 242 of the connection block 24, a first stop flange 231 located at a bottom side relative to the pivot rods 233, and a second stop flange 232 located at a top side relative to the pivot rods 233. The stop block 13 is disposed corresponding to the first stop flange 231 of the limiter member 23. The push block 14 is located at the first position-limit end 11 and disposed corresponding to the second stop flange 232 of the intermediate rail 2. The first position-limit end 11 of the inner rail 1 and the second mounting end 22 of the intermediate rail 2 extend toward one same side, namely, the rear side. The first mounting end 12 of the inner rail 1 and the second position-limit end 21 of the intermediate rail 2 extend toward the same opposite side, namely, the front side.

Figure 5:
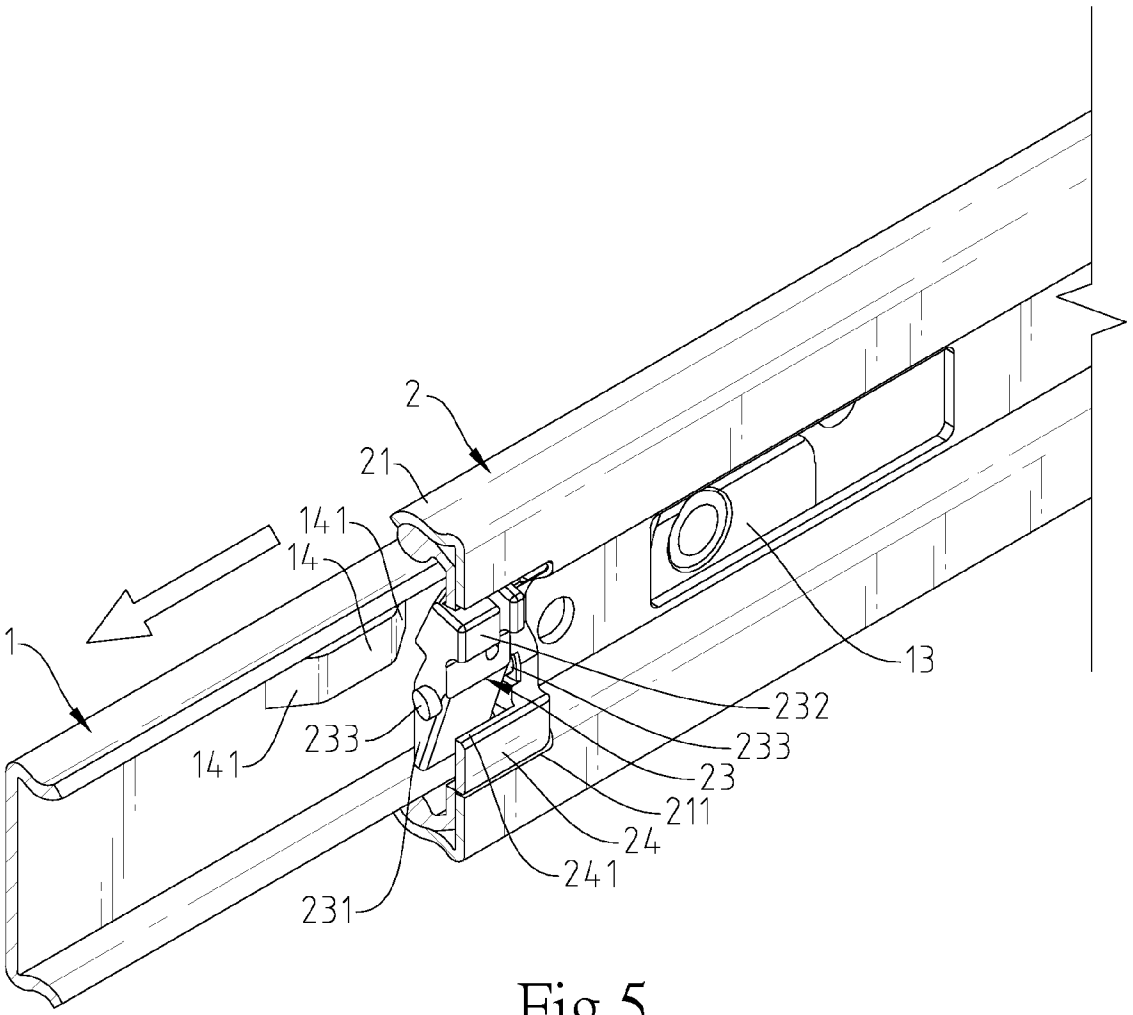
FIG. 5 is a schematic drawing, illustrating the inner ail moved relative to the intermediate rail in accordance with the present invention.
Figure 6:
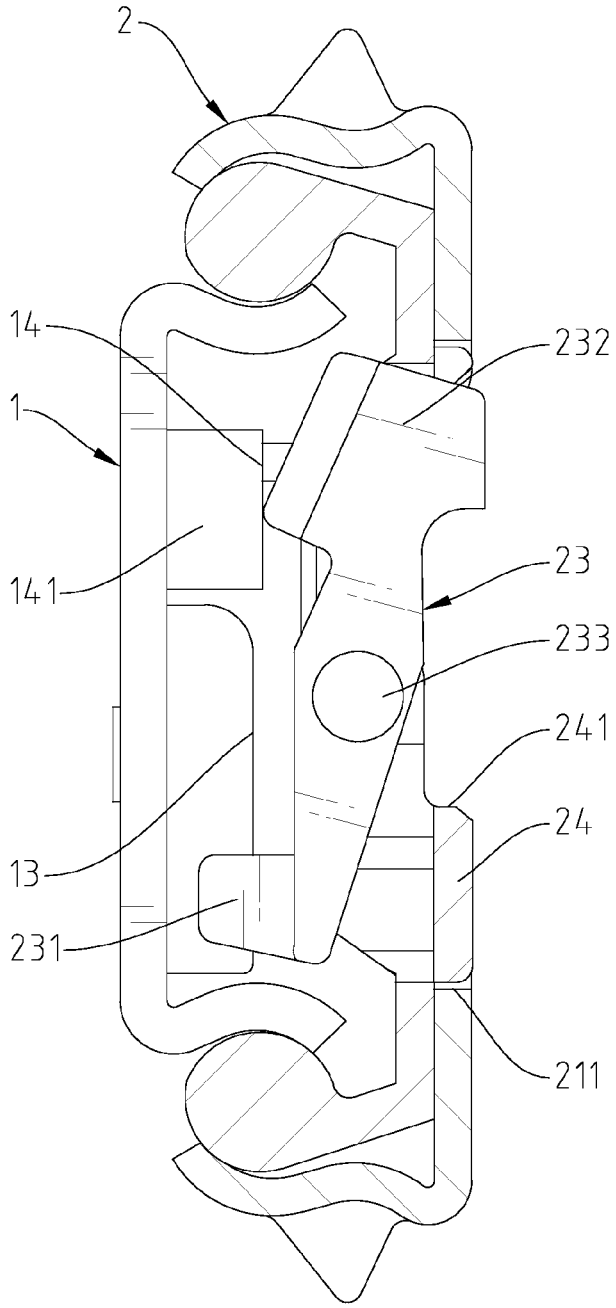
FIG. 6 is a sectional view illustrating relative action between the inner rail and the intermediate rail of the press-control type sliding rail assembly in accordance with the present invention (I).
Figure 7:
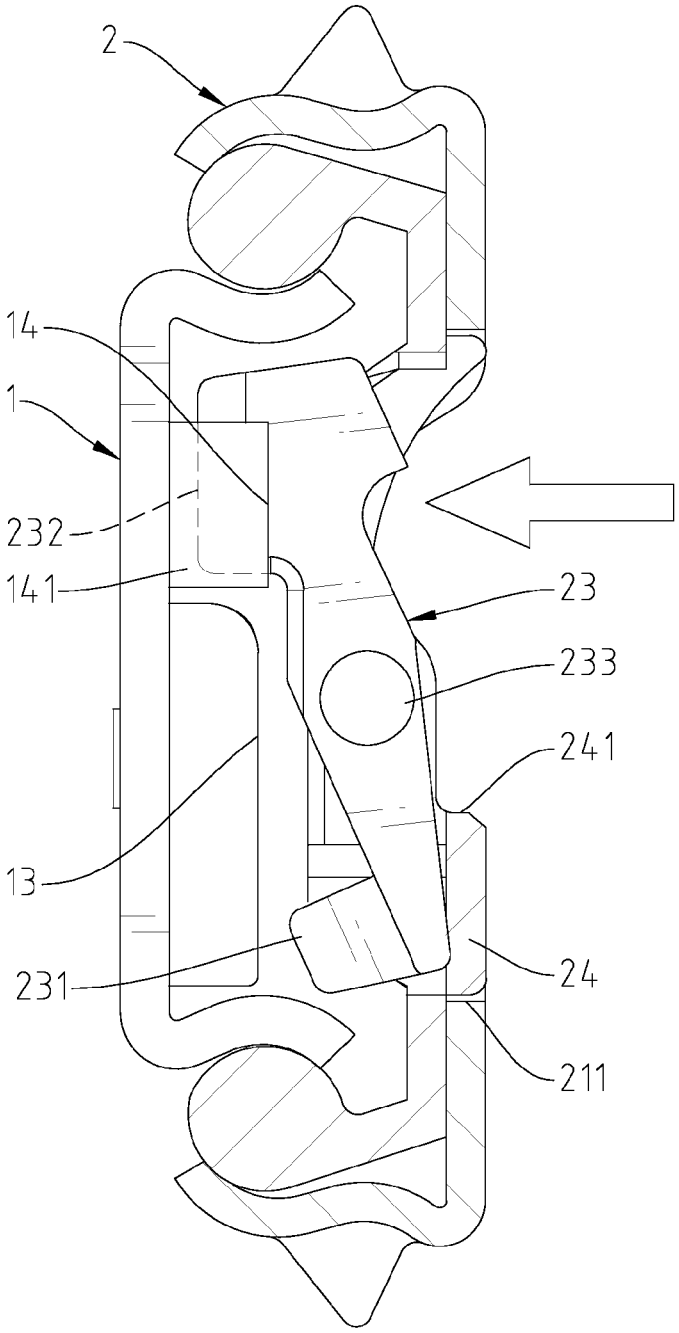
FIG. 7 is a sectional view illustrating the relative positioning between the inner rail and the intermediate rail of the press-control type sliding rail assembly in accordance with the present invention (II).
Figure 8:
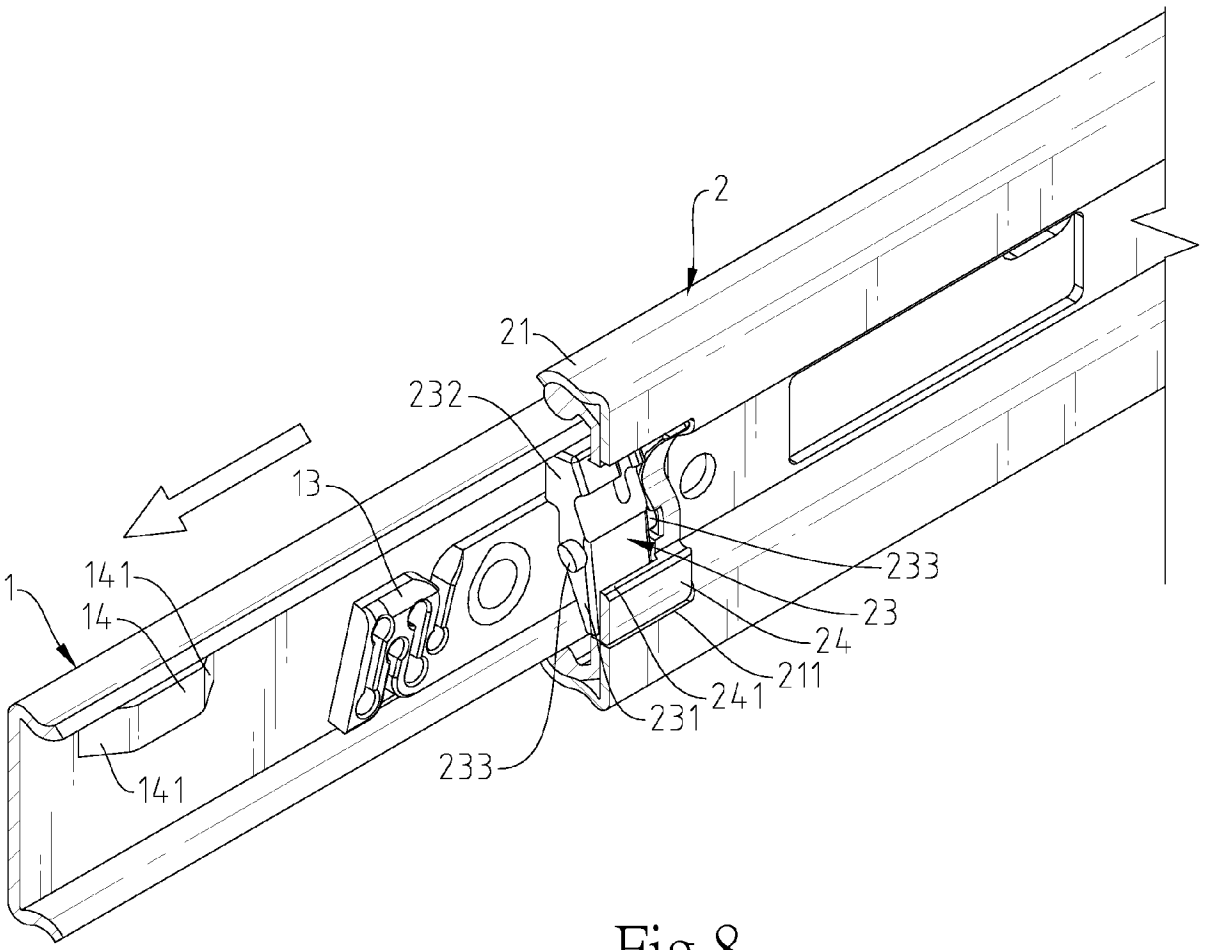
FIG. 8 is a sectional view illustrating relative action between the inner rail and the intermediate rail of the press-control type sliding rail assembly in accordance with the present invention (II).
Figure 9:
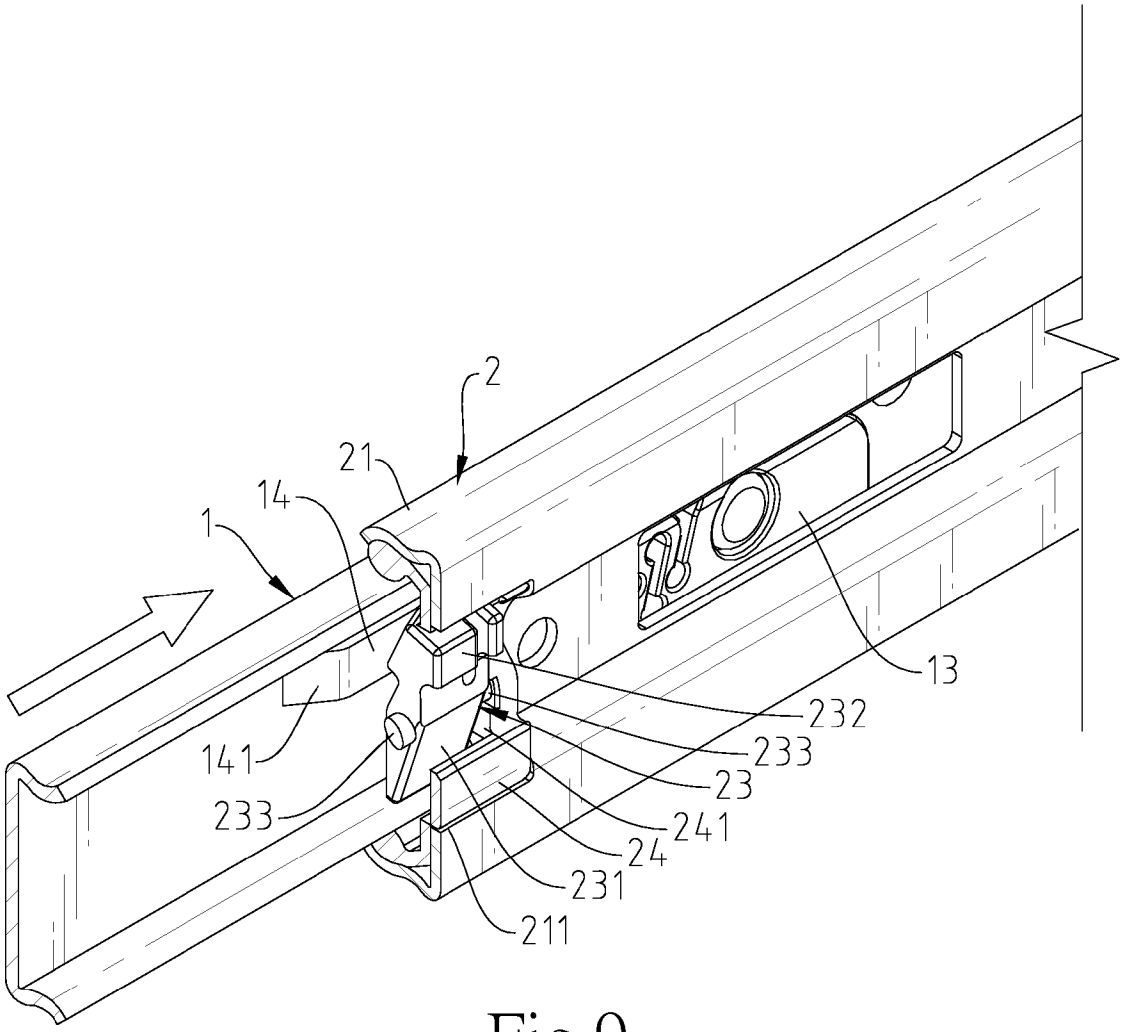
FIG. 9 is a sectional view illustrating relative action between the inner rail and the intermediate rail of the press-control type sliding rail assembly in accordance with the present invention (III).
Figure 10:
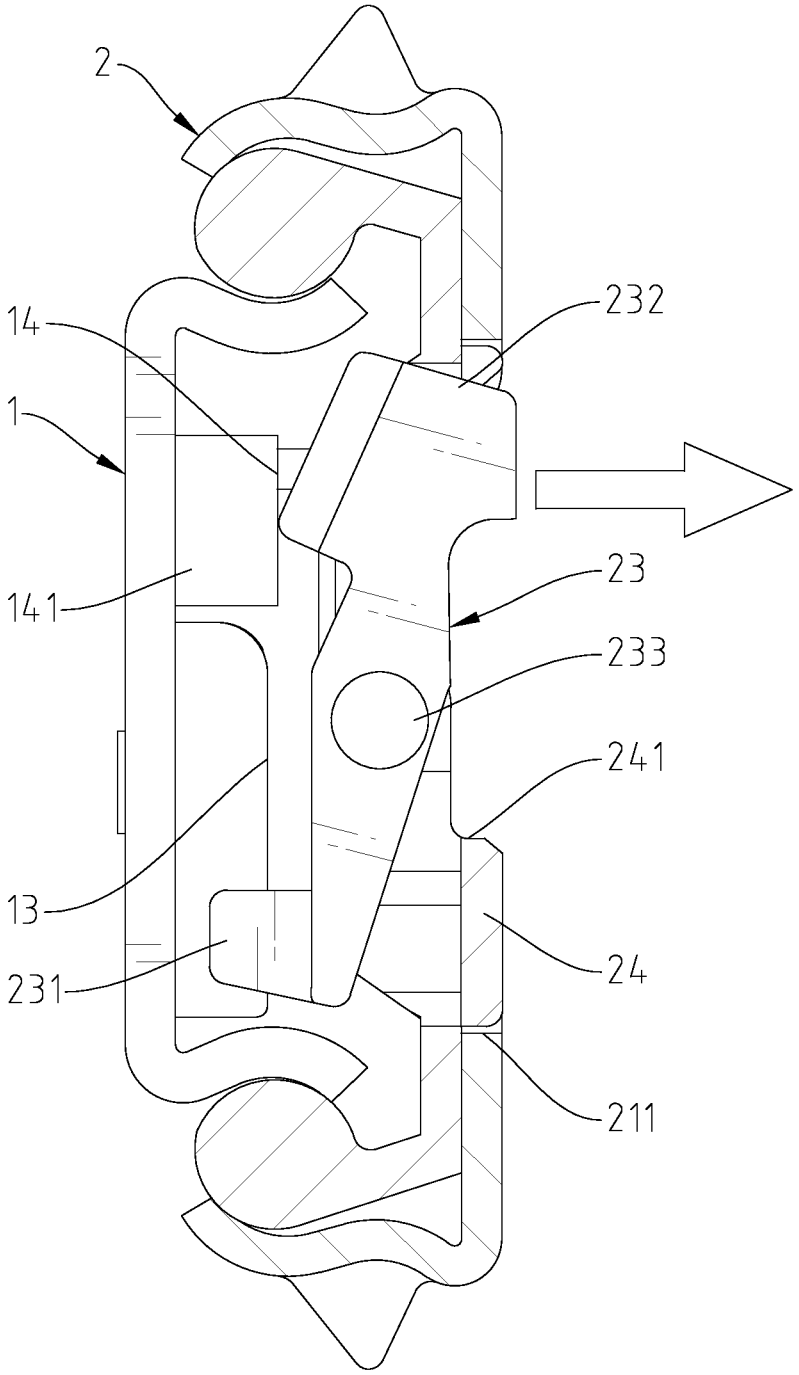
FIG. 10 is a sectional view illustrating the relative positioning between the inner rail and the intermediate rail of the press-control type sliding rail assembly in accordance with the present invention (III).

Referring to FIGS. 5-10 and FIG. 2 again, during application of the press-control type sliding rail assembly, the inner rail 1 is affixed to the drawer (not shown), and the outer rail 3 is affixed to the drawer cabinet (not shown). When the inner rail 1 is moved with the drawer in direction toward the first mounting end 12 of the inner rail 1, the stop block 13 of the inner rail 1 will be stopped by the first stop flange 231 of the limiter member 23 of the intermediate rail 2, preventing the inner rail 1 from falling out of the intermediate rail 2 (see FIGS. 5 and 6). When wishing to detach the drawer from the drawer cabinet, the user can press the second stop flange 232 of the limiter member 23. At this time, the second stop flange 232 and the first stop flange 231 are turned with the pivot rods 233 relative to the connection block 24 and the intermediate rail 2 toward the inner rail 1. When the second stop flange 232 is being moved toward the inner rail 1, the first stop flange 231 is being moved away from the inner rail 1 to release the stop block 13 from the constraint of the first stop flange 231, allowing the inner rail 1 to be separated from the intermediate rail 2 (see FIGS. 7 and 8). When wishing to couple the inner rail 1 to the intermediate rail 2, insert the first position-limit end 11 of the inner rail 1 into the second position-limit end 21 of the intermediate rail 2. At this time, the first stop flange 231 of the limiter member 23 is kept far from the inner rail 1, and therefore the stop block 13 can pass through the gap between the first stop flange 231 and the intermediate rail 2. Thereafter, the push block 14 will push the second stop flange 232 of the limiter member 23 away from the inner rail 1, causing the first stop flange 231 to be biased toward the inner rail 1 to stop the stop block 13 of the inner rail 1, and therefore the inner rail 1 is prohibited from falling out of the intermediate rail 2. Further, when going to remove the drawer from the drawer cabinet at this time, the user can press the second stop flange 232 of the limiter member 23 to bias the first stop flange 231 in direction away from the stop block 13, allowing removal of the inner rail 1 from the intermediate rail 2 to detach the drawer from the drawer cabinet.

In conclusion, the main feature of the present invention is the arrangement of the limiter member 23 that is mounted at the intermediate rail 2 and pivotable to bias the opposing first stop flange 231 and second stop flange 232 thereof in reversed directions. Thus, the user simply can press the second stop flange 232 of the limiter member 23 to unlock the inner rail 1 from the intermediate rail 2, allowing removal of the drawer with the inner rail 1 of each press-control type sliding rail assembly from the intermediate rail 2 of each press-control type sliding rail assembly in the drawer cabinet, facilitating mounting and dismounting. Thus, the invention effectively eliminates the drawbacks of the prior art design and has the advantage of simple structure.

What the invention claimed is:

1. A press-control type sliding rail assembly, comprising:

an intermediate rail; and an inner rail coupled to and movable in and out of said intermediate rail, said inner rail defining a first position-limit end and an opposing first mounting end, said intermediate rail defining a second position-limit end and an opposing second mounting end, said first position-limit end and said second mounting end respectively extending in a first direction, said first mounting end and said second position-limit end respectively extending in a second direction opposite to said first direction, wherein said intermediate rail comprises a limiter member pivotally located at said second position-limit end, said limiter member comprising a first stop flange and a second stop flange respectively located at opposing top and bottom sides thereof, said limiter member being turnable relative to said intermediate rail between a first position where said first stop flange is closer to said inner rail and said second stop flange is away from said inner rail and a second position where said second stop flange is closer to said inner rail and said first stop flange is away from said inner rail;

wherein said inner rail comprises a stop block fixedly disposed at a lower side between said first position-limit end and said first mounting end and facing toward said intermediate rail for stopping against said first stop flange when said limiter member is turned relative to said intermediate rail to said first position; and wherein said inner rail further comprises a push block fixedly disposed at an upper side between said first position-limit end and said first mounting end and facing toward said intermediate rail, and configured to push said second stop flange of said limiter member away from said inner rail to urge said limiter member into said first position, and when said first stop flange of said limiter member is moved in a direction away from said inner rail, said second stop flange of said limiter member is moved toward said inner rail into said second position.

2. The sliding rail assembly as claimed in claim 1, wherein said stop block is disposed near said first position-limit end of said inner rail, and said push block is disposed near said first mounting end of said inner rail.

3. The sliding rail assembly as claimed in claim 1, wherein said intermediate rail further comprises a connection block fixedly attached to said second position-limit end; said limiter member is pivotally coupled to said connection block and movable to bias said first stop flange and said second stop flange relative to said connection block in reversed directions.

* * * * *